US008708765B2

(12) United States Patent
Pope-Gusev

(10) Patent No.: US 8,708,765 B2
(45) Date of Patent: Apr. 29, 2014

(54) KIT FOR CONSTRUCTING A PLAY STRUCTURE

(75) Inventor: Erika Pope-Gusev, Sarasota, FL (US)

(73) Assignee: Fort Magic, LLC, Sarasota, FL (US)

( * ) Notice: Subject to any disclaimer, the term of this patent is extended or adjusted under 35 U.S.C. 154(b) by 218 days.

(21) Appl. No.: 13/298,387

(22) Filed: Nov. 17, 2011

(65) Prior Publication Data

US 2013/0130816 A1 May 23, 2013

(51) Int. Cl.
*A63H 17/00* (2006.01)
*A63H 33/00* (2006.01)

(52) U.S. Cl.
USPC ..... 446/93; 446/97; 446/124

(58) Field of Classification Search
USPC ..... 446/85, 93–95, 97–99, 124, 126; 52/2.13, 2.18, 2.22
See application file for complete search history.

(56) References Cited

U.S. PATENT DOCUMENTS 2,023,939 A * 12/1935 Talmadge ..... 244/154
2,281,792 A 5/1942 Ott
2,709,318 A 5/1955 Benjamin
3,176,428 A 4/1965 Slingluff
3,796,004 A 3/1974 Auerbach
3,856,241 A * 12/1974 Kupperman et al. ..... 244/154
3,873,220 A 3/1975 Kashiwabara
3,948,471 A * 4/1976 Pearce et al. ..... 244/153 R
4,078,328 A 3/1978 Rayment
4,170,082 A 10/1979 Freedman
4,251,106 A 2/1981 Gilbert
4,259,790 A * 4/1981 Borisof ..... 434/83
4,302,900 A 12/1981 Rayner
4,494,558 A 1/1985 Fidler, Jr.
5,265,557 A 11/1993 Lovitz
5,282,767 A 2/1994 Gelardi
5,318,470 A 6/1994 Denny
5,480,336 A 1/1996 Blanchard
5,487,691 A 1/1996 Chiu
5,690,446 A 11/1997 Poissant et al.
5,761,852 A * 6/1998 Liu ..... 52/2.18
5,779,240 A 7/1998 Santella
5,830,032 A 11/1998 Campbell
5,934,563 A 8/1999 Gapco
6,050,872 A 4/2000 Cahill et al.
6,223,757 B1 5/2001 Horvath et al.
6,468,128 B1 10/2002 Bala et al.
6,491,563 B1 12/2002 Bailey
6,641,453 B1 11/2003 Morales et al.

(Continued)

OTHER PUBLICATIONS

Website: www.finehomebuilding.com; last accessed Dec. 9, 2011.

(Continued)

*Primary Examiner* — Kien Nguyen
(74) *Attorney, Agent, or Firm* — Fraser Clemens Martin & Miller LLC; William A. Ziehler

(57) ABSTRACT

A kit for constructing a variety of play structures for children includes a plurality of arcuate tubes, a plurality of linear tubes, and a plurality of connectors. At least one of the tubes is releasably assembled together with another one of the tubes using the connectors to form a frame. An instruction manual provides directions for releasably assembling the tubes and the connectors to form the variety of play structures from the kit. The kit may also include at least one covering and at least one covering connector to releasably affix the covering to at least a portion of the frame of the play structure.

20 Claims, 13 Drawing Sheets

(56) References Cited

U.S. PATENT DOCUMENTS

| | | | | |
|---|---|---|---|---|
| 7,316,598 | B1 * | 1/2008 | Lock | 446/126 |
| 7,374,468 | B2 | 5/2008 | Flodin et al. | |
| 7,987,533 | B2 | 8/2011 | Phipps et al. | |
| 8,037,906 | B1 | 10/2011 | Grillo | |
| 2007/0178799 | A1 | 8/2007 | Rudell et al. | |
| 2008/0090486 | A1 | 4/2008 | Zawitz | |
| 2008/0121309 | A1 | 5/2008 | Boise et al. | |
| 2009/0272415 | A1 | 11/2009 | Zepeda | |
| 2010/0288320 | A1 | 11/2010 | Rehkemper | |

OTHER PUBLICATIONS website: www.aplastics.com; last accessed Dec. 9, 2011.

* cited by examiner

KIT FOR CONSTRUCTING A PLAY STRUCTURE

FIELD OF THE INVENTION

The invention relates generally to a kit for children. More particularly, the invention relates to a kit for constructing a variety of play structures for children.

BACKGROUND OF THE INVENTION

Play structures for small play or action figures are well known. Typically, the play structures have a central theme such as a barn, house or cave, and are relatively small enclosed structures. The size of a typical play structure is generally such that small children may insert their hands, together with a play or action figure into the play structure. In addition to being relatively small and having limited access to the interior, such play structures are typically rather intricate and difficult to assemble.

Larger play structures are generally a cross-section of a structure such as a house, wherein children can play with small play or action figures either on the outside facade of the structure of in the interior cut-away. Another type of the larger play structures allows the children to enter and exit an interior space of the play structure. However, these larger play structures are typically assembled from large injection molded panels which are heavy, awkward to handle, and not easily assembled and disassembled.

It would be desirable to develop a kit for constructing a variety of play structures for children. Each of the play structures would advantageously permit both imaginative, interactive play with the play structure and role playing by a child inside the play structure itself. Additionally, each of the play structures and play surfaces may both incorporate features having a single, central theme.

SUMMARY OF THE INVENTION

In concordance and agreement with the present invention, a kit which can be releasably assembled into at least one play structure for children, wherein the play structure permits both imaginative, interactive play with the play structure and role playing by a child inside the play structure itself, has surprisingly been discovered.

In one embodiment, the kit for constructing a variety of play structures comprises: a plurality of arcuate first tubes; a plurality of arcuate second tubes, wherein at least one of the arcuate first tubes and the arcuate second tubes is substantially rigid; a plurality of linear tubes, wherein the linear tubes are substantially rigid; and a plurality of connectors for releasably assembling at least one of the arcuate first tubes, the arcuate second tubes, and the linear tubes together with another one of the arcuate first tubes, the arcuate second tubes, and the linear tubes to form a frame of the play structure.

In another embodiment, the kit for constructing a variety of play structures comprises: a plurality of arcuate first tubes; a plurality of arcuate second tubes; a plurality of arcuate third tubes; a plurality of linear fourth tubes; a plurality of linear fifth tubes; a plurality of linear sixth tubes; a plurality of linear seventh tubes, wherein the first tubes, the second tubes, the third tubes, the fourth tubes, the fifth tubes, the sixth tubes, and the seventh tubes are substantially rigid; and a plurality of connectors for releasably assembling at least one of the first tubes, the second tubes, the third tubes, the fourth tubes, the fifth tubes, the sixth tubes, and the seventh tubes together with another one of the first tubes, the second tubes, the third tubes, the fourth tubes, the fifth tubes, the sixth tubes, and the seventh tubes to form a frame.

The invention also includes a method of constructing a play structure.

The method comprises the steps of: providing a kit including a plurality of arcuate first tubes, a plurality of arcuate second tubes, wherein at least one of the arcuate first tubes and the arcuate second tubes is substantially rigid, and a plurality of linear tubes, wherein the linear tubes are substantially rigid; and releasably assembling at least one of the arcuate first tubes, the arcuate second tubes, and the linear tubes together with another one of the arcuate first tubes, the arcuate second tubes, and the linear tubes to form a frame of the play structure.

BRIEF DESCRIPTION OF THE DRAWINGS

The above, as well as other objects and advantages of the invention, will become readily apparent to those skilled in the art from reading the following detailed description of various embodiments of the invention when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
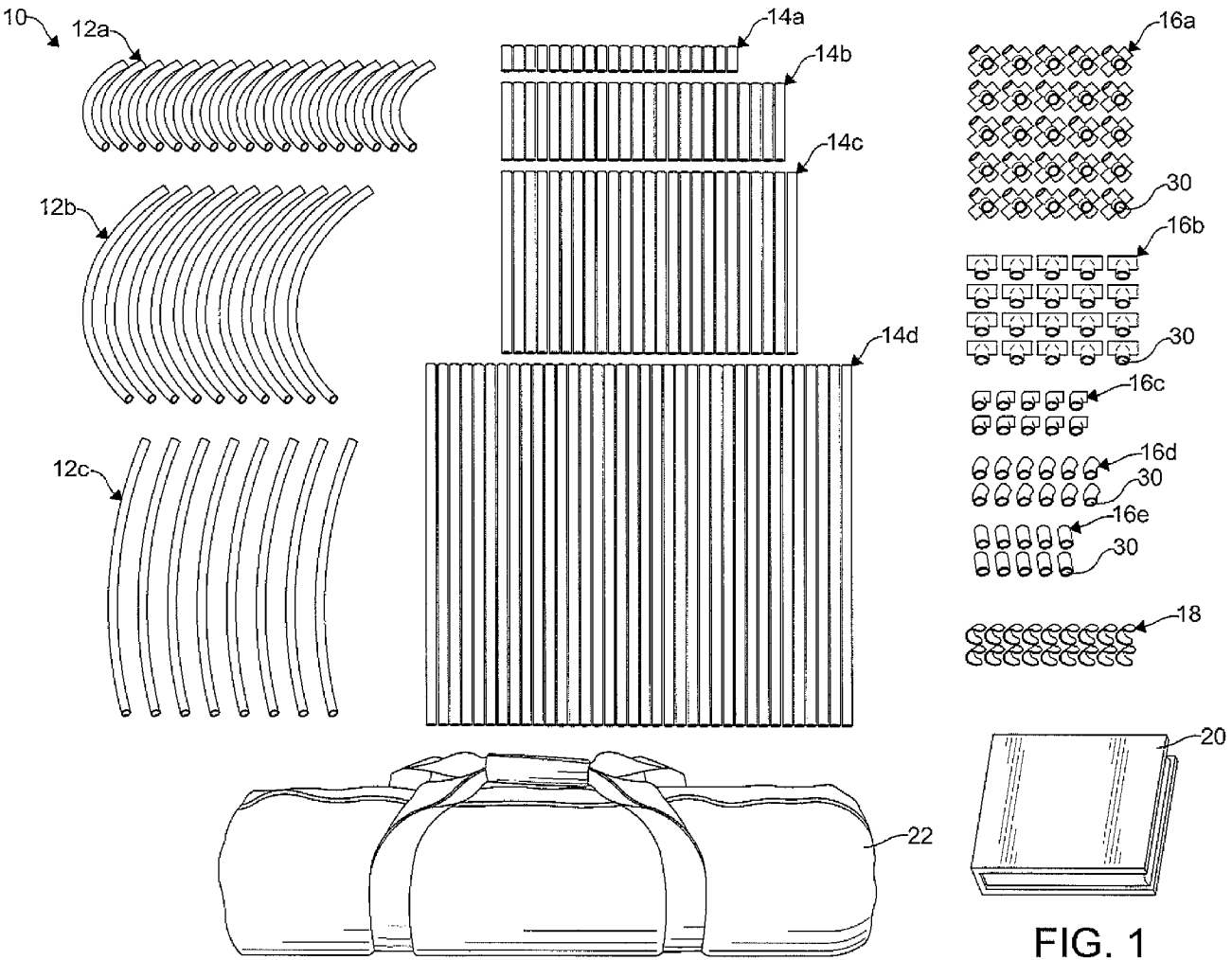
FIG. 1 is a perspective view of a kit for constructing at least one play structure for children according to an embodiment of the present invention.

FIG. 1 shows a kit 10 for constructing at least one play structure 100, 100', 200, 200', 300, 300', 400, 400', 500, 500', 600, 600', 700, 700', 800, 800', 900, 900', 1000, 1100 (shown in FIGS. 2-21) for children according to the present invention. The play structures 100, 100', 200, 200', 300, 300', 400, 400', 500, 500' are transportation vehicle-shaped configurations, the play structures 600, 600', 700, 700' are building-shaped configurations, and the play structures 800', 900, 900', 1000 are animal-shaped configurations. it is understood that the kit 10 can be used to construct play structures other than the play structures 100, 100', 200, 200', 300, 300', 400, 400', 500, 500', 600, 600', 700, 700', 800, 800', 900, 900', 1000, 1100 described hereinbelow. For example, the kit 10 can be used to construct a play structure having other building-shaped configurations such as a horse barn-shaped configuration and a play house-shaped configuration, for example; other animal-shaped configurations such as a dragon-shaped configuration, a knight-shaped configuration, a unicorn-shaped configuration, a Pegasus-shaped configuration, a sea monster-shaped configuration, and an alien-shaped configuration, for example; and other transportation vehicle-shaped configurations such as an unidentified flying object (UFO)-shaped configuration, a space ship-shaped configuration, a hot air balloon-shaped configuration, a tank-shaped configuration, a Hummer®-shaped configuration, a fire truck-shaped configuration, a covered wagon-shaped configuration, and the like, for example.

The kit 10 shown includes a plurality of arcuate first tubes 12*a*, a plurality of arcuate second tubes 12*b*, a plurality of arcuate third tubes 12*c*, a plurality of linear fourth tubes 14*a*, a plurality of linear fifth tubes 14*b*, a plurality of linear sixth tubes 14*c*, a plurality of linear seventh tubes 14*d*, a plurality of 6-way tube connectors 16*a*, a plurality of 3-way tube connectors 16*b*, a plurality of 90-degree tube connectors 16*c*, a plurality of 45-degree tube connectors 16*d*, a plurality of coupling tube connectors 16*e*, a plurality of covering connectors 18, an instruction manual 20, and a carrying bag 22. It is understood that the instruction manual 20 provides directions such as written descriptions and/or diagrams, for example, showing how to construct each of the play structures 100, 100', 200, 200', 300, 300', 400, 400', 500, 500', 600, 600', 700, 700', 800, 800', 900, 900', 1000, 1100 so that adults and/or children can use the kit 10. The tubes 12*a*, 12*b*, 12*c*, 14*a*, 14*b*, 14*c*, 14*d* and connectors 16*a*, 16*b*, 16*c*, 16*d*, 16*e*, 18 are substantially rigid and can have a distinct color to assist in assembling the play structures 100, 100', 200, 200', 300, 300', 400, 400', 500, 500', 600, 600', 700, 700', 800, 800', 900, 900', 1000, 1100 according to the instruction manual 20.

In a non-limiting example, the kit 10 includes eighteen (18) of the first tubes 12*a*, ten (10) of the second tubes 12*b*, eight (8) of the third tubes 12*c*, twenty (20) of the fourth tubes 14*a*, twenty-four (24) of the fifth tubes 14*b*, twenty-five (25) of the sixth tubes 14*c*, thirty-six (36) of the seventh tubes 14*d*, twenty-five (25) of the 6-way tube connectors 16*a*, twenty (20) of the 3-way tube connectors 16*b*, ten (10) of the 90-degree tube connectors 16*c*, twelve (12) of the 45-degree tube connectors 16*d*, ten (10) of the coupling tube connectors 16*e*, and one hundred thirty (130) of the covering connectors 18. Additional or fewer tubes 12*a*, 12*b*, 12*c*, 14*a*, 14*b*, 14*c*, 14*d* and connectors 16*a*, 16*b*, 16*c*, 16*d*, 16*e*, 18 than shown can be included in the kit 10 if desired. It is understood, however, a number and a variety of play structures which can be constructed from the kit 10 depends on the number of each of the tubes 12*a*, 12*b*, 12*c*, 14*a*, 14*b*, 14*c*, 14*d* and connectors 16*a*, 16*b*, 16*c*, 16*d*, 16*e*, 18 included in the kit 10.

In the embodiment shown, each of the first tubes 12*a* has an arc length in a range of about 8 inches to about 10 inches and an angle of curvature of about 90 degrees. In a non-limiting example, the arc length of each of the first tubes 12*a* is about 9.4 inches. Accordingly, four of the first tubes 12*a* assembled together form a circle having a diameter in a range of about 10 inches to about 14 inches. Each of the second tubes 12*b* has an arc length in a range of about 17 inches to about 20 inches and an angle of curvature of about 90 degrees. In a non-limiting example, the arc length of each of the second tubes 12*b* is about 18.8 inches. Accordingly, four of the second tubes 12*b* assembled together form a circle having a diameter in a range of about 22 inches to about 26 inches. Each of the third tubes 12*c* has an arc length in a range of about 17 inches to about 20 inches and an angle of curvature of about 45 degrees. In a non-limiting example, the arc length of each of the third tubes 12*c* is about 18.8 inches. According, eight of the third tubes 12*c* assembled together form a circle having a diameter of about 46 inches to about 50 inches.

In the embodiment shown, each of the fourth tubes 14*a* has a length in a range of about 1 inch to about 4 inches. In a non-limiting example, the length of each of the fourth tubes 14*a* is about 2 inches. Each of the fifth tubes 14*b* has a length in a range of about 3 inches to about 7 inches. In a non-limiting example, the length of each of the fifth tubes 14*b* is about 5 inches. Each of the sixth tubes 14*c* has a length in a range of about 10 inches to about 14 inches. In a non-limiting example, the length of each of the sixth tubes 14*c* is about 12 inches. Each of the seventh tubes 14*d* has a length in a range of about 22 inches to about 26 inches. In a non-limiting example, the length of each of the seventh tubes 14*d* is about 24 inches.

As commonly known, the 6-way connector 16*a* includes a pair of openings 30 formed along three separate axes (i.e. x, y, z), the 3-way connector 16*b* includes a pair of openings 30 formed along one axis and an opening 30 formed along a separate, perpendicular axis, the 90-degree connector 16*c* includes a pair of openings 30 formed at 90 degrees in respect of one another, the 45-degree connector 16*d* includes a pair of openings 30 formed at 45 degrees in respect of one another, and the coupling connector 16*e* includes a pair of opening 30 formed at 180 degrees in respect of one another.

Each of the connectors 16*a*, 16*b*, 16*c*, 16*d*, 16*e* receives at least one of the tubes 12*a*, 12*b*, 12*c*, 14*a*, 14*b*, 14*c*, 14*d* therein. To releasably assemble the tubes 12*a*, 12*b*, 12*c*, 14*a*, 14*b*, 14*c*, 14*d* with the connectors 16*a*, 16*b*, 16*c*, 16*d*, 16*e*, an end of each of the tubes 12*a*, 12*b*, 12*c*, 14*a*, 14*b*, 14*c*, 14*d* is inserted into one of the openings 30 formed in one of the connectors 16*a*, 16*b*, 16*c*, 16*d*, 16*e* using an axial movement in respect of the axis of the tube 12*a*, 12*b*, 12*c*, 14*a*, 14*b*, 14*c*, 14*d* in a first direction towards the respective connector 16*a*, 16*b*, 16*c*, 16*d*, 16*e* and a rotational movement in a first direction (i.e. clockwise). To disassemble the tubes 12*a*, 12*b*, 12*c*, 14*a*, 14*b*, 14*c*, 14*d* with the connectors 16*a*, 16*b*, 16*c*, 16*d*, 16*e*, each of the tubes 12*a*, 12*b*, 12*c*, 14*a*, 14*b*, 14*c*, 14*d* is removed from the opening 30 formed in one of the connectors 16*a*, 16*b*, 16*c*, 16*d*, 16*e* using an axial movement in respect of the axis of the tube 12*a*, 12*b*, 12*c*, 14*a*, 14*b*, 14*c*, 14*d* in an opposite second direction away from the respective connector 16*a*, 16*b*, 16*c*, 16*d*, 16*e* and a rotational movement in an opposite second direction (i.e. counter-clockwise).

The kit 10 may also include at least one covering 24 (shown in FIGS. 3, 5, 7, 9, 11, 13, 15, 17, 19). Each of the play structures 100', 200', 300', 400', 500', 600', 700', 800', 900' includes the at least one covering 24 to enhance imaginative, interactive play of a child with the play structure and role playing by the child inside the play structure itself.

Figure 2:
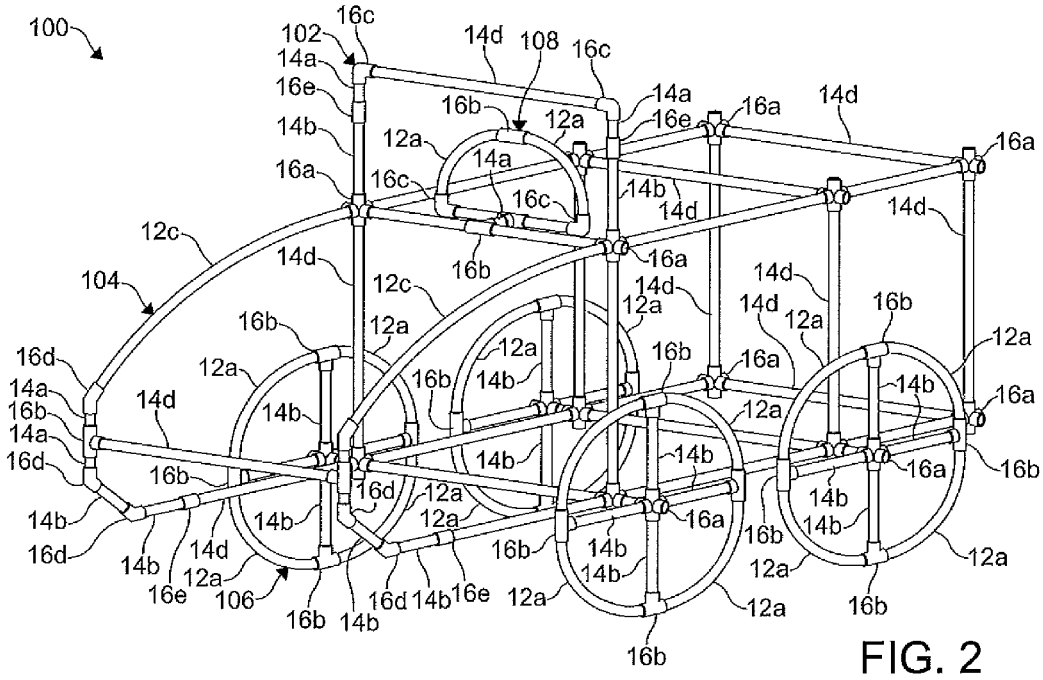
FIG. 2 is a perspective view of a play structure constructed from the kit illustrated in FIG. 1, wherein the play structure has an automobile-shaped configuration.
Figure 3:
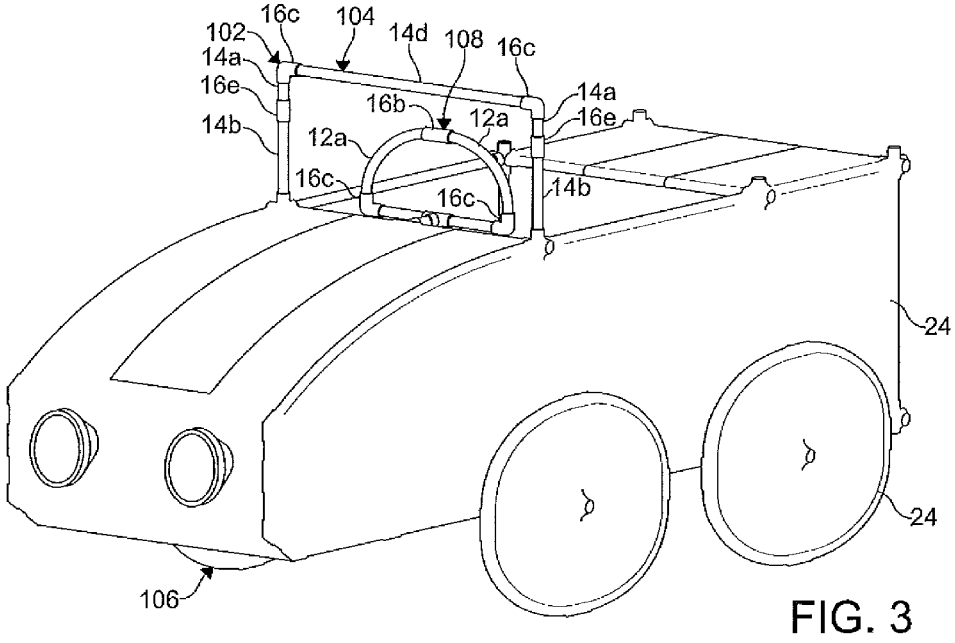
FIG. 3 is a perspective view of the play structure of FIG. 2 having a covering disposed on at least a portion thereof.

FIGS. 2-3 show the kit 10 releasably assembled to construct the play structures 100, 100' having an automobile-shaped configuration. In certain embodiments, each of the play structures 100, 100' is constructed from eighteen (18) of the first tubes 12*a*, two (2) of the third tubes 12*c*, eleven (11) of the fourth tubes 14*a*, twenty-four (24) of the fifth tubes 14*b*, fourteen (14) of the sixth tubes 14*c*, eleven (11) of the seventh tubes 14*d*, seventeen (17) of the 6-way connectors 16*a*, nineteen (19) of the 3-way connectors 16*b*, six (6) of the 90-degree connectors 16*c*, four (4) of the 45-degree connectors 16*d*, and five (5) of the coupling connectors 16*e*.

A frame 102 of the play structures 100, 100', constructed from the tubes 12*a*, 12*c*, 14*a*, 14*b*, 14*c*, 14*d* and the connectors 16*a*, 16*b*, 16*c*, 16*d*, 16*e*, includes a main body 104, a plurality of wheels 106, and a steering device 108. As shown in FIG. 2, the main body 104 is formed by releasably assembling the tubes 12*c*, 14*a*, 14*b*, 14*c*, 14*d* together using the connectors 16*a*, 16*b*, 16*c*, 16*d*, 16*e* into a box-like structure. Each of the wheels 106 is formed by releasably assembling the first tubes 12*a* together with the fifth tubes 14*b* using the connectors 16*a*, 16*b*. The steering device 108 is formed by releasably assembling the first tubes 12*a* together with the fifth tubes 14*b* using the connectors 16*a*, 16*c*, 16*e*. Each of the wheels 106 and the steering device 108 is releasably attached to the main body 104 using one of the tubes 14*a*.

As shown in FIG. 3, the play structure 100' further includes the at least one covering 24 releasably affixed to the frame 104. In certain embodiments, the at least one covering 24 is releasably affixed to the frame 104 using the covering connectors 18 (shown in FIG. 1). In particular, an edge of the at least one covering 24 is aligned with one of the tubes 12*a*, 12*c*, 14*a*, 14*b*, 14*c*, 14*d* and secured with one of the covering connectors 18. The covered tubes 12*a*, 12*c*, 14*a*, 14*b*, 14*c*, 14*d* are rolled until the at least one covering 24 is pulled tight and the covering connectors 18 are not visible.

Figure 4:
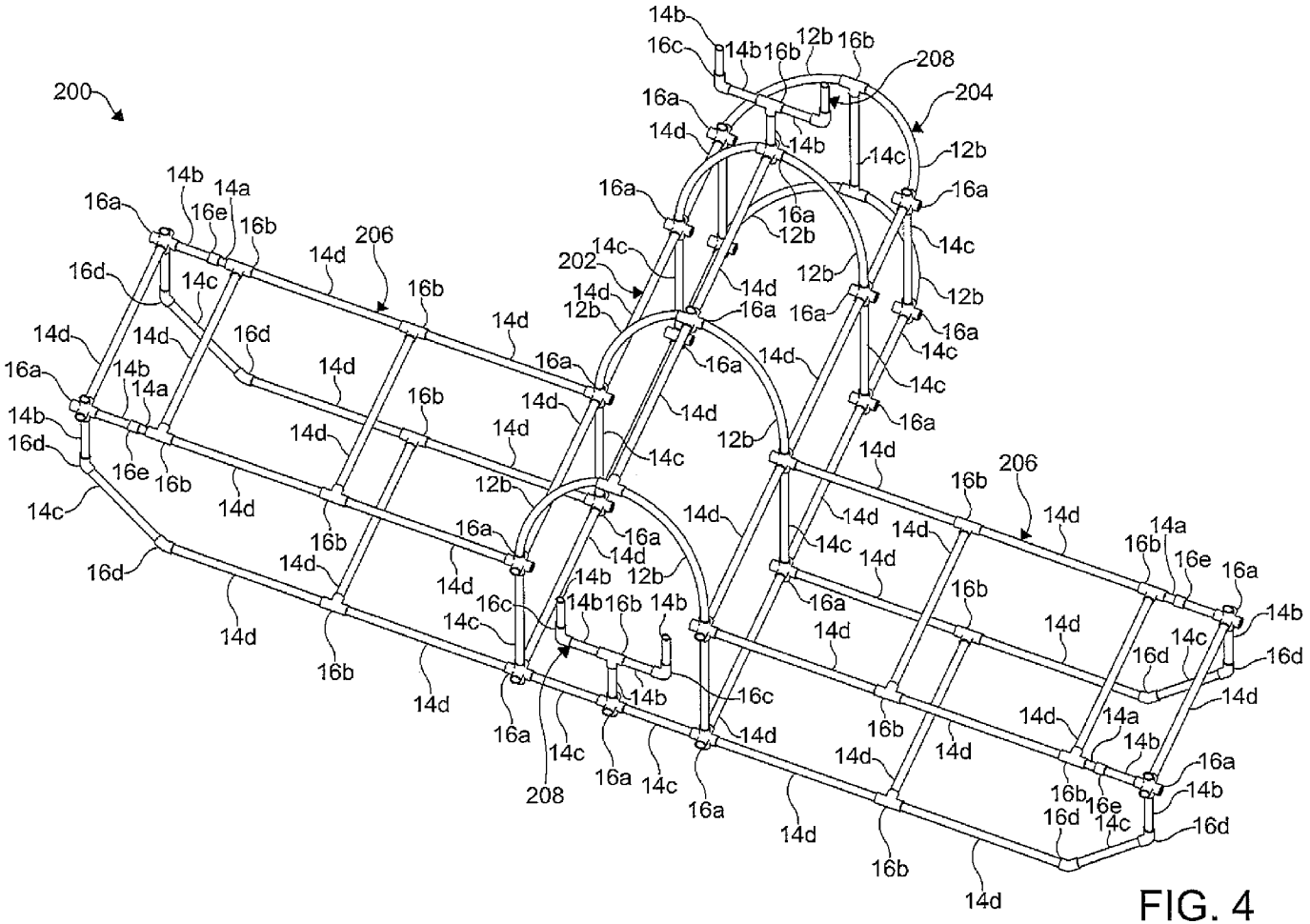
FIG. 4 is a perspective view of a play structure constructed from the kit illustrated in FIG. 1, wherein the play structure has an airplane-shaped configuration.
Figure 5:
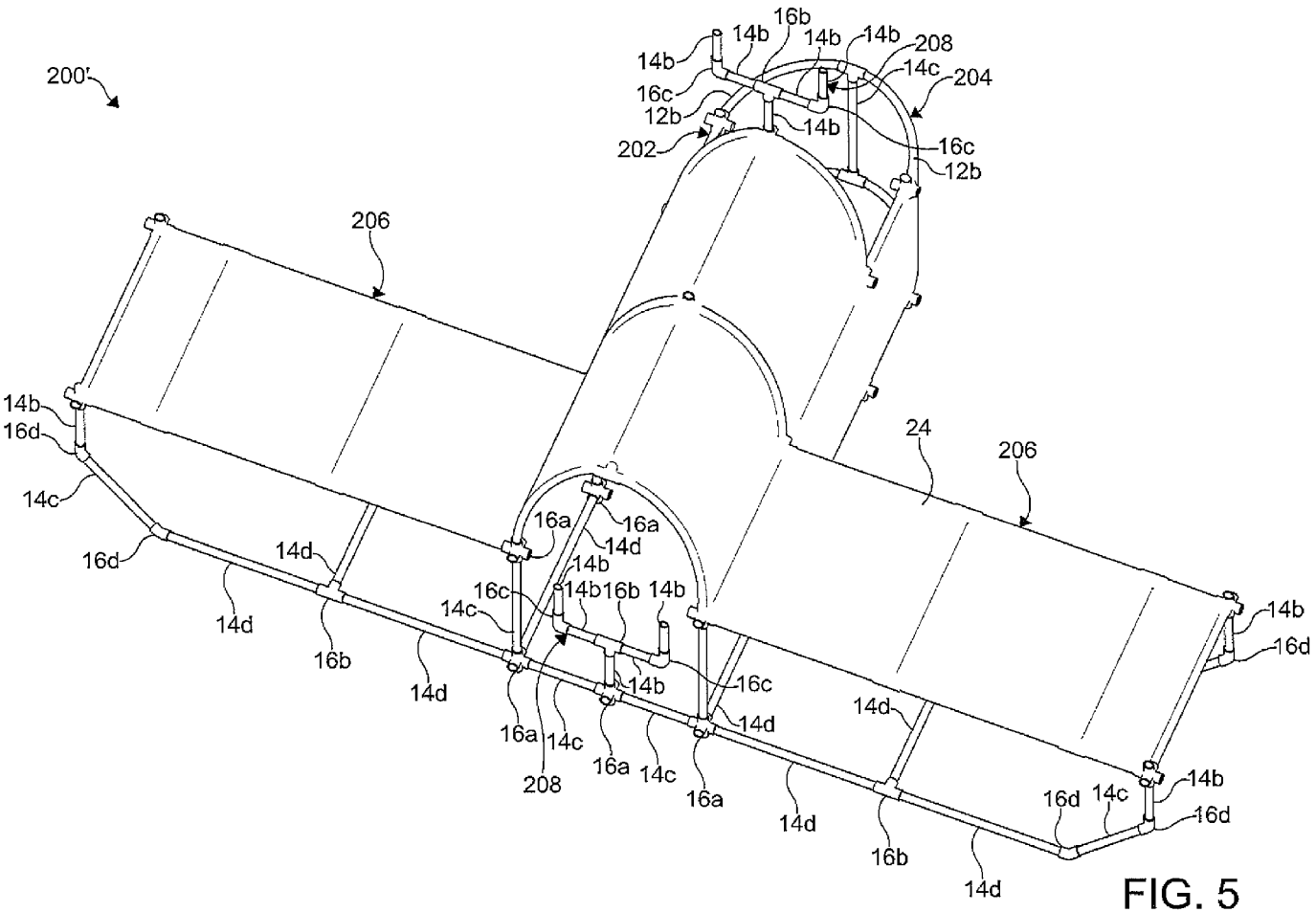
FIG. 5 is a perspective view of the play structure of FIG. 4 having a covering disposed on at least a portion thereof.

As shown in FIGS. 4-5, the kit 10 is used to construct the play structures 200, 200' having an airplane-shaped configuration. In certain embodiments, each of the play structures 200, 200' is constructed from ten (10) of the second tubes 12*b*, four (4) of the fourth tubes 14*a*, eighteen (18) of the fifth tubes 14*b*, seventeen (17) of the sixth tubes 14*c*, thirty-four (34) of the seventh tubes 14*d*, twenty-two (22) of the 6-way connectors 16*a*, eighteen (18) of the 3-way connectors 16*b*, four (4) of the 90-degree connectors 16*c*, eight (8) of the 45-degree connectors 16*d*, and four (4) of the coupling connectors 16*e*.

A frame 202 of the play structures 200, 200', constructed from the tubes 12*b*, 14*a*, 14*b*, 14*c*, 14*d* and the connectors 16*a*, 16*b*, 16*c*, 16*d*, 16*e*, includes a main body 204, a pair of laterally, opposed wings 206, and a pair of steering devices 208. As shown in FIG. 4, the main body 204 is formed by releasably assembling the tubes 12*b*, 14*c*, 14*d* together using the connectors 16*a*, 16*b*, into a box-like structure. Each of the wings 206 is formed by releasably assembling the tubes 14*a*, 14*b*, 14*c*, 14*d* together using the connectors 16*a*, 16*b*, 16*d*, 16*e*. The steering devices 208 are formed by releasably assembling the fifth tubes 14*b* together using the connectors 16*b*, 16*c*. Each of the wings 206 and the steering devices 208 is releasably attached to the main body 204 by inserting ends of the tubes 14*b*, 14*d* into the openings 30 of the 6-way connector 16*a*.

As shown in FIG. 5, the play structure 200' further includes the at least one covering 24 releasably affixed to the frame 204. In certain embodiments, the at least one covering 24 is releasably affixed to the frame 204 using the covering connectors 18 (shown in FIG. 1). In particular, an edge of the at least one covering 24 is aligned with one of the tubes 12*b*, 14*a*, 14*b*, 14*c*, 14*d* and secured with one of the covering connectors 18. The covered tubes 12*b*, 14*a*, 14*b*, 14*c*, 14*d* are rolled until the at least one covering 24 is pulled tight and the covering connectors 18 are not visible.

Figure 6:
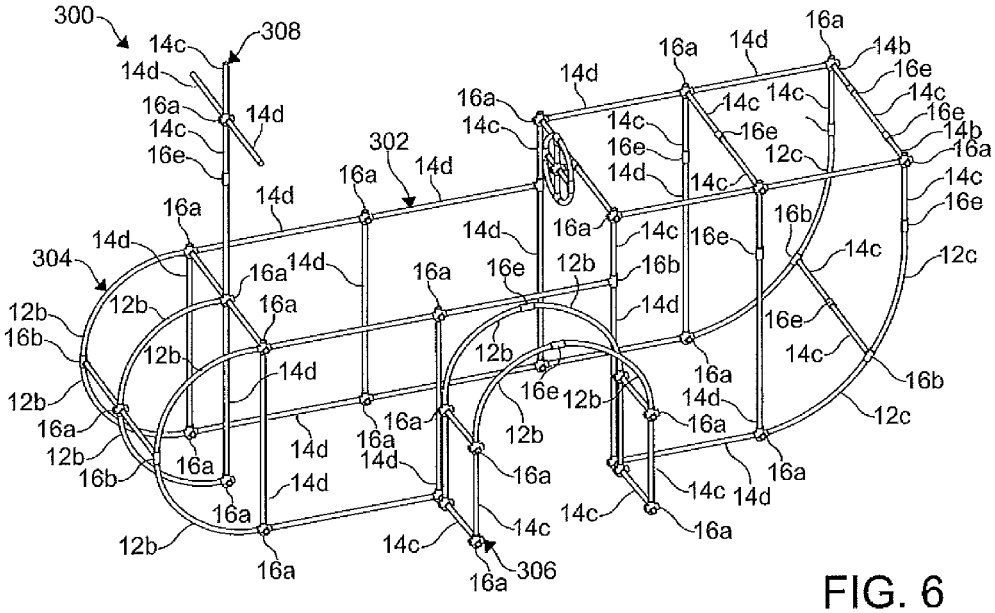
FIG. 6 is a perspective view of a play structure constructed from the kit illustrated in FIG. 1, wherein the play structure has a pirate ship-shaped configuration.
Figure 7:
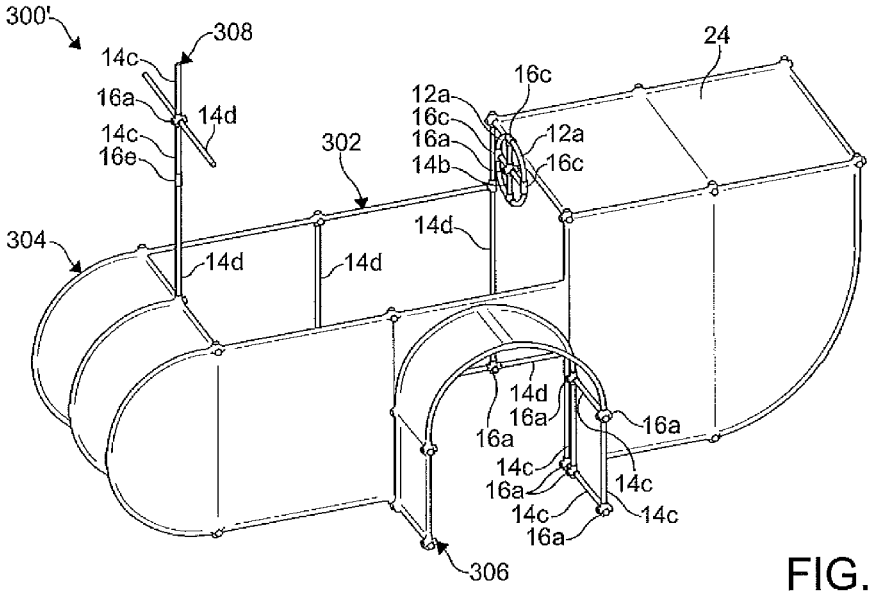
FIG. 7 is a perspective view of the play structure of FIG. 6 having a covering disposed on at least a portion thereof.

As shown in FIGS. 6-7, the kit 10 is used to construct the play structures 300, 300' having a pirate ship-shaped configuration. In certain embodiments, each of the play structures 300, 300' is constructed from four (4) of the first tubes 12*a*, ten (10) of the second tubes 12*b*, four (4) of the third tubes 12*c*, five (5) of the fourth tubes 14*a*, four (4) of the fifth tubes 14*b*, twenty-two (22) of the sixth tubes 14*c*, thirty-six (36) of the seventh tubes 14*d*, twenty-five (25) of the 6-way connectors 16*a*, nineteen (19) of the 3-way connectors 16*b*, and ten (10) of the coupling connectors 16*e*.

A frame 302 of the play structures 300, 300', constructed from the tubes 12*a*, 12*b*, 12*c*, 14*a*, 14*b*, 14*c*, 14*d* and the connectors 16*a*, 16*b*, 16*e*, includes a main body 304, an entrance opening 306, a mast 308, and a steering device 310. As shown in FIG. 6, the main body 304 is formed by releasably assembling the tubes 12*b*, 12*c*, 14*c*, 14*d* together using the connectors 16*a*, 16*b*, 16*e* into a box-like structure. The entrance opening 306 is formed by releasably assembling the tubes 12*b*, 14*c*, together using the connectors 16*a*, 16*b*. The mast 308 is formed by releasably assembling the tubes 12*c*, 12*d* together using the connectors 16*a*, 16*e*. The steering device 310 is formed by releasably assembling the first tubes 12*a* together with the fifth tubes 14*b* using the connectors 16*a*, 16*b*. The entrance opening 306 and the steering device 310 are releasably attached to the main body 304 by the fourth tubes 14*a*. The mast 308 is releasably attached to the main body 304 by inserting an end of the tube 14*d* into the opening 30 of the 6-way connector 16*a*.

As shown in FIG. 7, the play structure 300' further includes the at least one covering 24 releasably affixed to the frame 302. In certain embodiments, the at least one covering 24 is releasably affixed to the frame 302 using the covering connectors 18 (shown in FIG. 1). In particular, an edge of the at least one covering 24 is aligned with one of the tubes 12*b*, 12*c*, 14*a*, 14*b*, 14*c*, 14*d* and secured with one of the covering connectors 18. The covered tubes 12*b*, 12*c*, 14*a*, 14*b*, 14*c*, 14*d* are rolled until the at least one covering 24 is pulled tight and the covering connectors 18 are not visible.

Figure 8:
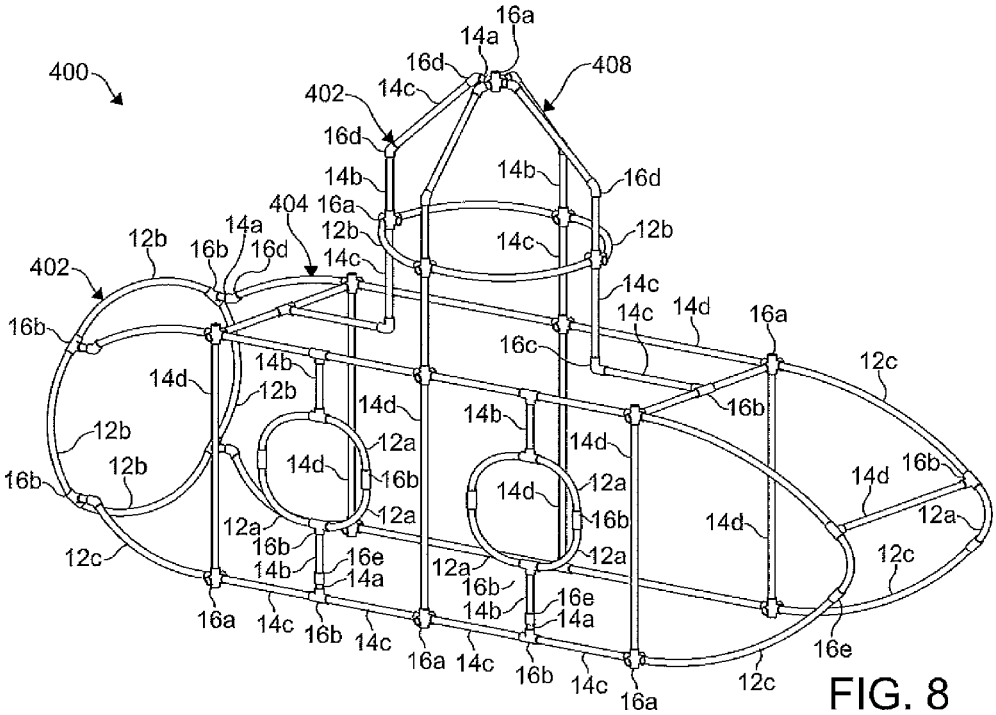
FIG. 8 is a perspective view of a play structure constructed from the kit illustrated in FIG. 1, wherein the play structure has a submarine-shaped configuration.
Figure 9:
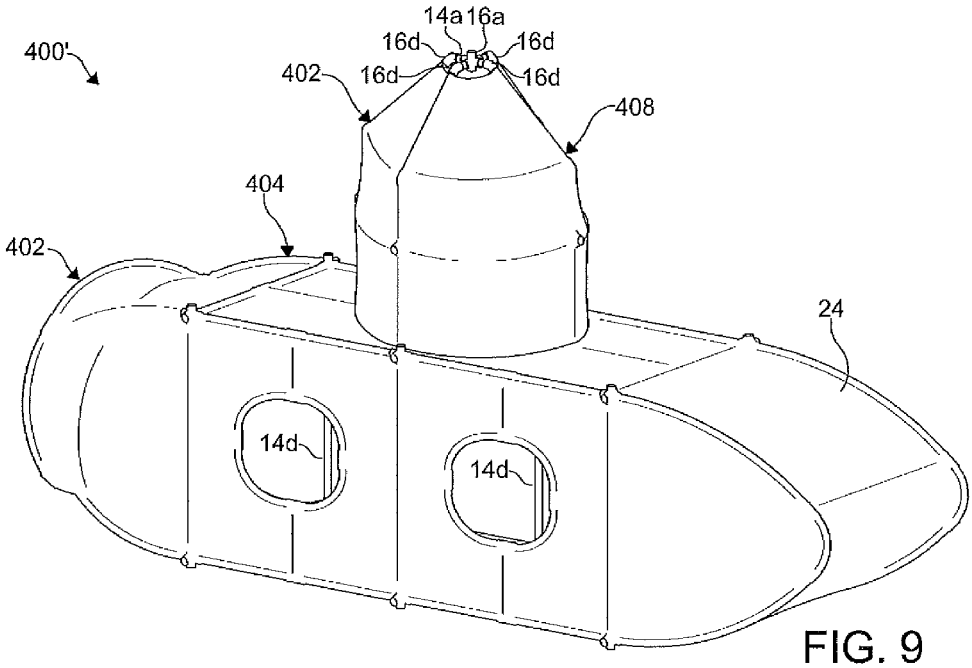
FIG. 9 is a perspective view of the play structure of FIG. 8 having a covering disposed on at least a portion thereof.

As shown in FIGS. 8-9, the kit 10 is used to construct the play structures 400, 400' having a submarine-shaped configuration. In certain embodiments, each of the play structures 400, 400' is constructed from ten (10) of the first tubes 12*a*, eight (8) of the second tubes 12*b*, eight (8) of the third tubes 12*c*, ten (10) of the fourth tubes 14*a*, eight (8) of the fifth tubes 14*b*, twenty-two (22) of the sixth tubes 14*c*, eleven (11) of the seventh tubes 14*d*, seventeen (17) of the 6-way connectors 16*a*, sixteen (16) of the 3-way connectors 16*b*, two (2) of the 90-degree connectors 16*c*, twelve (12) of the 45-degree connectors 16*d*, and eight (8) of the coupling connectors 16*e*.

A frame 402 of the play structures 400, 400', constructed from the tubes 12*a*, 12*b*, 12*c*, 14*a*, 14*b*, 14*c*, 14*d* and the connectors 16*a*, 16*b*, 16*c*, 16*d*, 16*e*, includes a main body 404, an entrance opening 406, and a hatch 408. As shown in FIG. 8, the main body 404 is formed by releasably assembling the tubes 12*a*, 12*c*, 14*a*, 14*b*, 14*c*, 14*d* together using the connectors 16*a*, 16*b*, 16*c*, 16*d*, 16*e* into a box-like structure. The entrance opening 406 is formed by releasably assembling the tubes 12*b* together using the connectors 16*b*. The hatch 408 is formed by releasably assembling the tubes 12*b*, 14*a*, 14*b*, 14*c* together using the connectors 16*a*, 16*d*, 16*e*. The entrance opening 406 is releasably attached to the main body 404 by the fourth tubes 14*a*. The hatch 408 can be pivotally attached to the main body 404 if desired.

As shown in FIG. 9, the play structure 400' further includes the at least one covering 24 releasably affixed to the frame 402. In certain embodiments, the at least one covering 24 is releasably affixed to the frame 402 using the covering connectors 18 (shown in FIG. 1). In particular, an edge of the at least one covering 24 is aligned with one of the tubes 12*a*, 12*b*, 12*c*, 14*a*, 14*b*, 14*c*, 14*d* and secured with one of the covering connectors 18. The covered tubes 12*a*, 12*b*, 12*c*, 14*a*, 14*b*, 14*c*, 14*d* are rolled until the at least one covering 24 is pulled tight and the covering connectors 18 are not visible.

Figure 10:
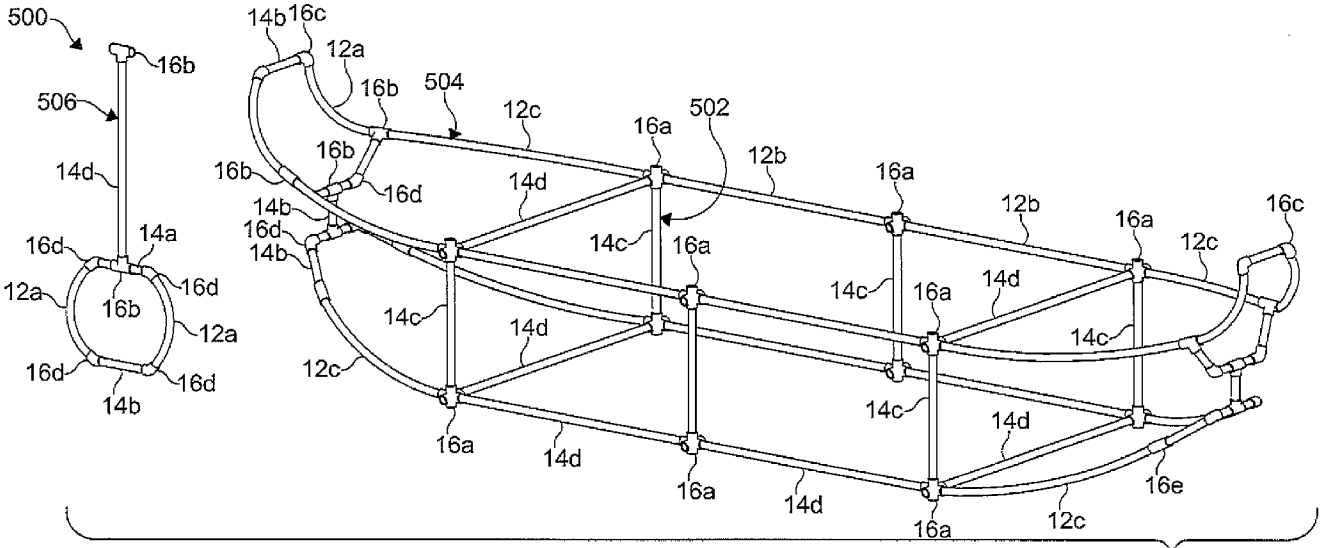
FIG. 10 is a perspective view of a pair of play structures constructed from the kit illustrated in FIG. 1, wherein one of the play structures has a canoe-shaped configuration and another of the play structures has a paddle-shaped configuration.
Figure 11:
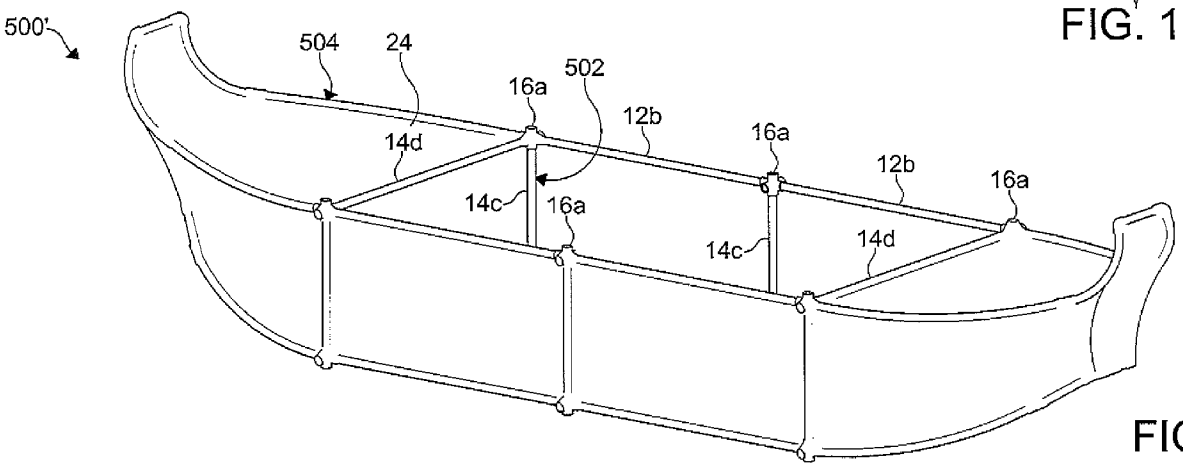
FIG. 11 is a perspective view of the canoe-shaped play structure of FIG. 10 having a covering disposed on at least a portion thereof.

As shown in FIGS. 10-11, the kit 10 is used to construct the play structures 500, 500' having a canoe-shaped configuration. In certain embodiments, each of the play structures 500, 500' is constructed from six (6) of the first tubes 12*a*, eight (8) of the third tubes 12*c*, ten (10) of the fourth tubes 14*a*, thirteen (13) of the fifth tubes 14*b*, six (6) of the sixth tubes 14*c*, thirteen (13) of the seventh tubes 14*d*, twelve (12) of the 6-way connectors 16*a*, ten (10) of the 3-way connectors 16*b*, four (4) of the 90-degree connectors 16*c*, twelve (12) of the 45-degree connectors 16*d*, and four (4) of the coupling connectors 16*e*.

A frame 502 of the play structures 500, 500', constructed from the tubes 12*a*, 12*c*, 14*a*, 14*b*, 14*c*, 14*d* and the connectors 16*a*, 16*b*, 16*c*, 16*d*, 16*e*, includes a main body 504 and an accessory 506. As shown in FIG. 10, the main body 504 is formed by releasably assembling the tubes 12*a*, 12*c*, 14*a*, 14*b*, 14*c*, 14*d* together using the connectors 16*a*, 16*b*, 16*c*, 16*d*, 16*e* into a box-like structure. The accessory 506 is formed by releasably assembling the tubes 12*a*, 14*a*, 14*b*, 14*d* together using the connectors 16*b*, 16*d*.

As shown in FIG. 11, the play structure 500' further includes the at least one covering 24 releasably affixed to the frame 502. In certain embodiments, the at least one covering 24 is releasably affixed to the frame 502 using the covering connectors 18 (shown in FIG. 1). In particular, an edge of the at least one covering 24 is aligned with one of the tubes 12*a*, 12*c*, 14*a*, 14*b*, 14*c*, 14*d* and secured with one of the covering connectors 18. The covered tubes 12*a*, 12*c*, 14*a*, 14*b*, 14*c*, 14*d* are rolled until the at least one covering 24 is pulled tight and the covering connectors 18 are not visible.

Figure 13:
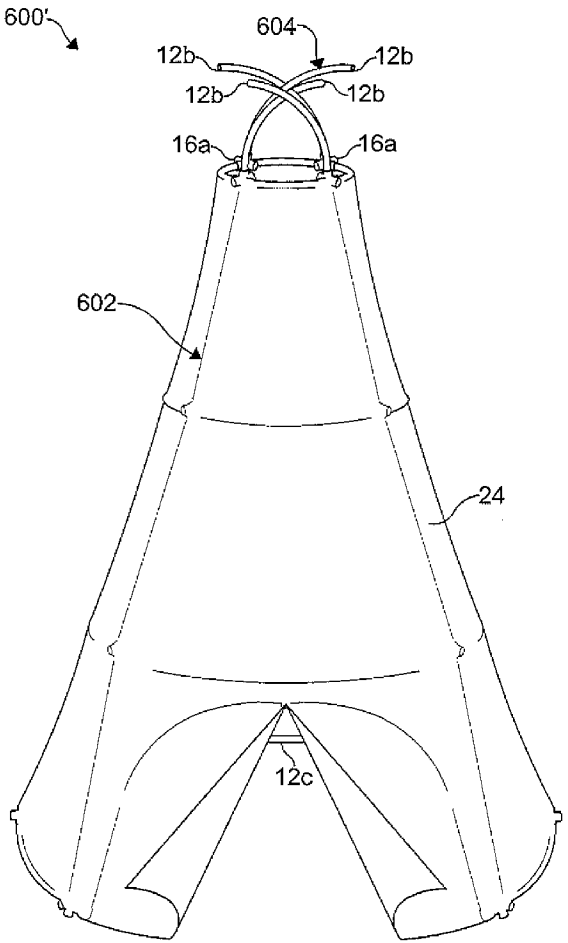
FIG. 13 is a perspective view of the play structure of FIG. 12 having a covering disposed on at least a portion thereof.
Figure 12:
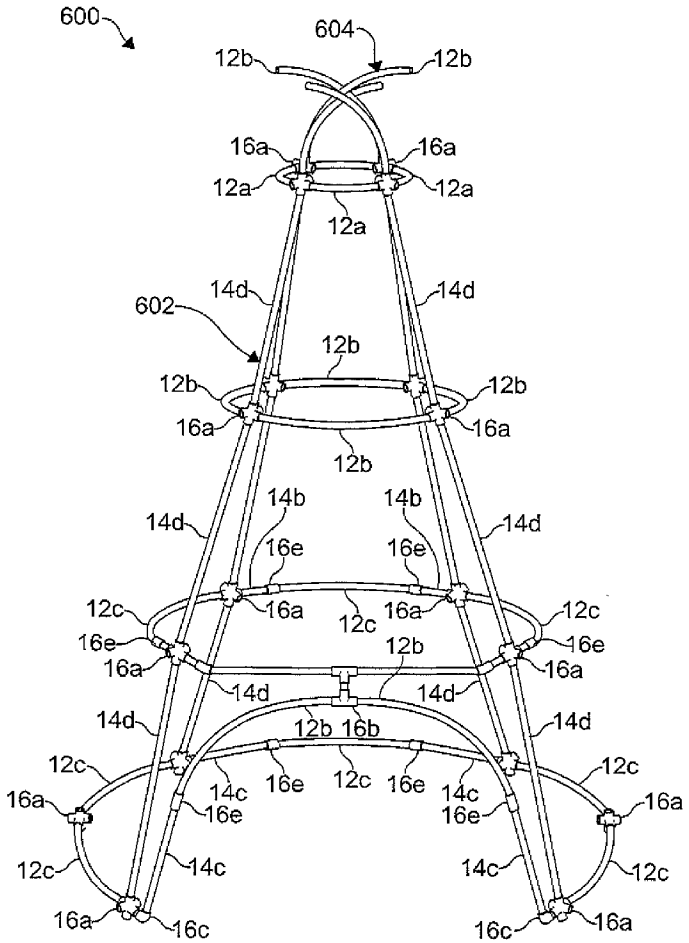
FIG. 12 is a perspective view of a play structure constructed from the kit illustrated in FIG. 1, wherein the play structure has a teepee-shaped configuration.

As shown in FIGS. 12-13, the kit 10 is used to construct the play structures 600, 600' having a teepee-shaped configuration. In certain embodiments, each of the play structures 600, 600' is constructed from four (4) of the first tubes 12*a*, ten (10) of the second tubes 12*b*, eight (8) of the third tubes 12*c*, three (3) of the fourth tubes 14*a*, eight (8) of the fifth tubes 14*b*, six (6) of the sixth tubes 14*c*, twelve (12) of the seventh tubes 14*d*, eighteen (18) of the 6-way connectors 16*a*, two (2) of the 3-way connectors 16*b*, two (2) of the 90-degree connectors 16*c*, two (2) of the 45-degree connectors 16*d*, and ten (10) of the coupling connectors 16*e*.

A frame 602 of the play structures 600, 600', constructed from the tubes 12*a*, 12*b*, 12*c*, 14*a*, 14*b*, 14*c*, 14*d* and the connectors 16*a*, 16*b*, 16*c*, 16*d*, 16*e*, includes a main body 604. As shown in FIG. 12, the main body 604 is formed by releasably assembling the tubes 12*a*, 12*b*, 12*c*, 14*a*, 14*b*, 14*c*, 14*d* together using the connectors 16*a*, 16*b*, 16*c*, 16*d*, 16*e* into a teepee-like structure.

As shown in FIG. 13, the play structure 600' further includes the at least one covering 24 releasably affixed to the frame 602. In certain embodiments, the at least one covering 24 is releasably affixed to the frame 602 using the covering connectors 18 (shown in FIG. 1). In particular, an edge of the at least one covering 24 is aligned with one of the tubes 12*a*, 12*b*, 12*c*, 14*a*, 14*b*, 14*c*, 14*d* and secured with one of the covering connectors 18. The covered tubes 12*a*, 12*b*, 12*c*, 14*a*, 14*b*, 14*c*, 14*d* are rolled until the at least one covering 24 is pulled tight and the covering connectors 18 are not visible.

Figure 14:
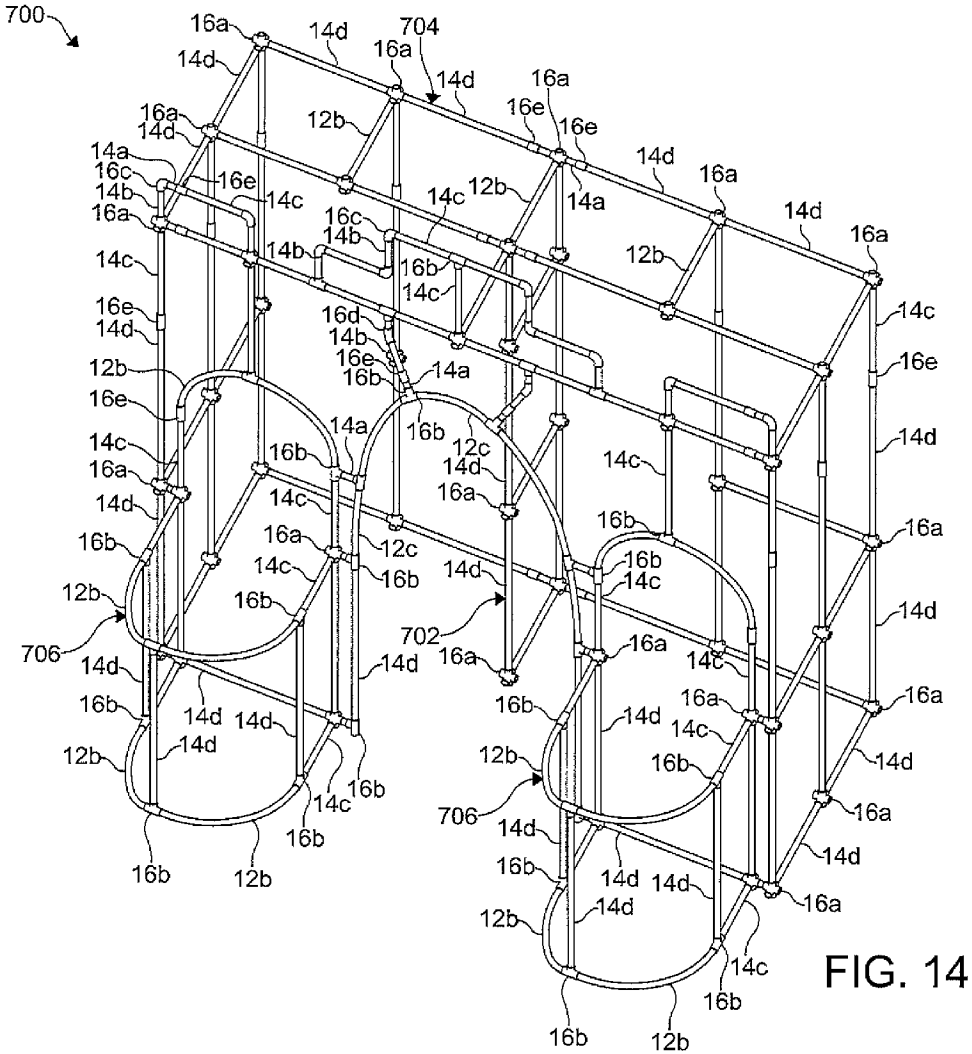
FIG. 14 is a perspective view of a play structure constructed from the kit illustrated in FIG. 1, wherein the play structure has a castle-shaped configuration.
Figure 15:
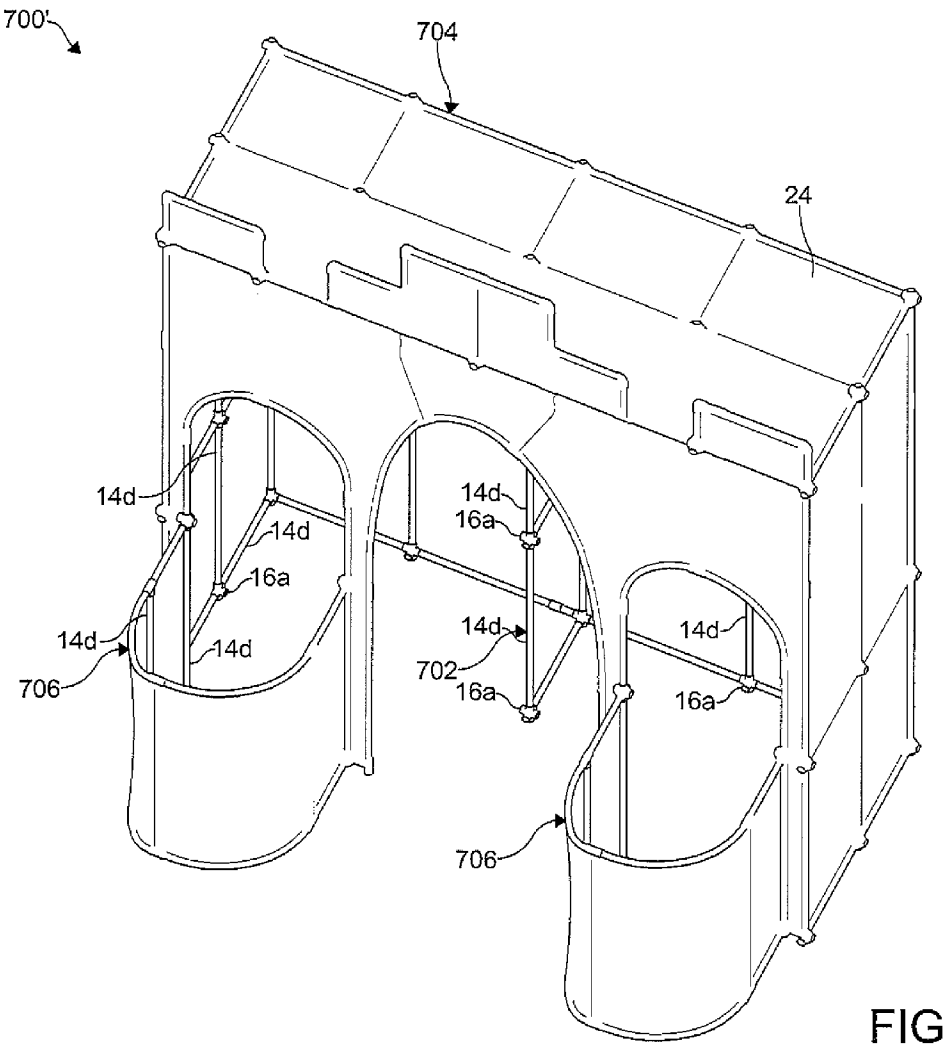
FIG. 15 is a perspective view of the play structure of FIG. 14 having a covering disposed on at least a portion thereof.

As shown in FIGS. 14-15, numerous kits 10 can be used to construct the play structures 700, 700' having a castle-shaped configuration. In certain embodiments, each of the play structures 700, 700' is constructed from twelve (12) of the second tubes 12*b*, three (3) of the third tubes 12*c*, twenty-two (22) of the fourth tubes 14*a*, ten (10) of the fifth tubes 14*b*, forty-one (41) of the sixth tubes 14*c*, sixty-nine (69) of the seventh tubes 14*d*, forty-two (42) of the 6-way connectors 16*a*, thirty-two (32) of the 3-way connectors 16*b*, ten (10) of the 90-degree connectors 16*c*, two (2) of the 45-degree connectors 16*d*, and twenty (20) of the coupling connectors 16*e*.

A frame 702 of the play structures 700, 700', constructed from the tubes 12*b*, 12*c*, 14*a*, 14*b*, 14*c*, 14*d* and the connectors 16*a*, 16*b*, 16*c*, 16*d*, 16*e*, includes a main body 704 and a pair of laterally, extending play areas 706. As shown in FIG. 14, the main body 704 is formed by releasably assembling the tubes 12*b*, 12*c*, 14*a*, 14*b*, 14*c*, 14*d* together using the connectors 16*a*, 16*b*, 16*c*, 16*d*, 16*e* into a box-like structure. The play areas 706 are formed by releasably assembling the tubes 12*b*, 14*c*, 14*d* together using the connectors 16*b*. Each of the play areas 706 is releasably attached to the main body 704 by inserting an end of the sixth tubes 14*c* into the opening 30 of the 6-way connector 16*a*.

As shown in FIG. 15, the play structure 700' further includes the at least one covering 24 releasably affixed to the frame 702. In certain embodiments, the at least one covering 24 is releasably affixed to the frame 702 using the covering connectors 18 (shown in FIG. 1). In particular, an edge of the at least one covering 24 is aligned with one of the tubes 12*b*, 12*c*, 14*a*, 14*b*, 14*c*, 14*d* and secured with one of the covering connectors 18. The covered tubes 12*b*, 12*c*, 14*a*, 14*b*, 14*c*, 14*d* are rolled until the at least one covering 24 is pulled tight and the covering connectors 18 are not visible.

Figure 16:
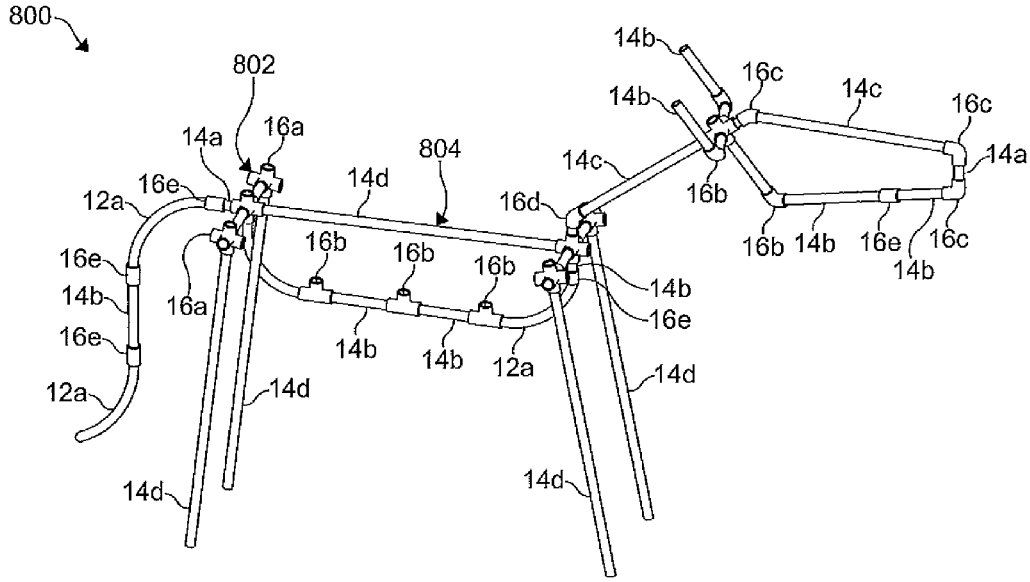
FIG. 16 is a perspective view of a play structure constructed from the kit illustrated in FIG. 1, wherein the play structure has a horse-shaped configuration.
Figure 17:
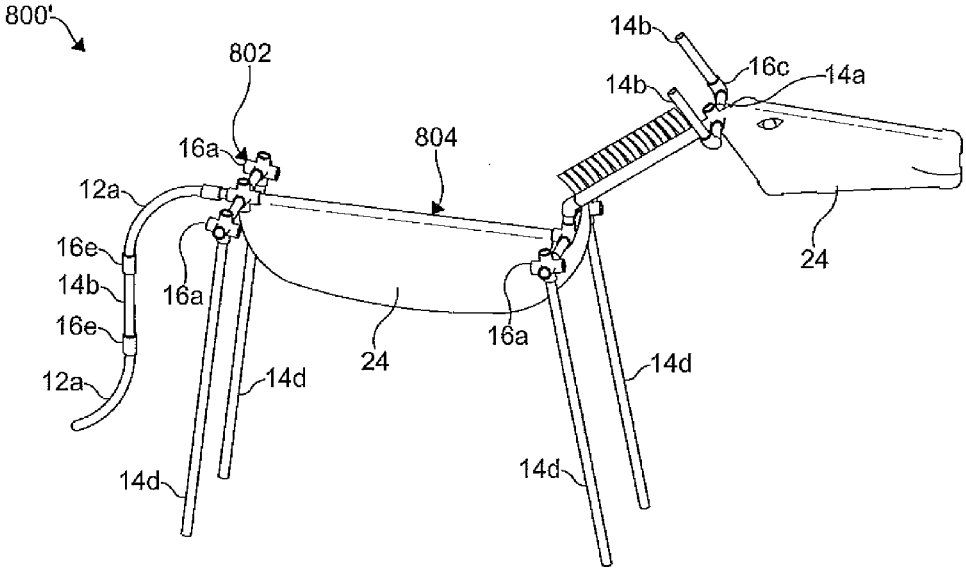
FIG. 17 is a perspective view of the play structure of FIG. 16 having a covering disposed on at least a portion thereof.

As shown in FIGS. 16-17, the kit 10 is used to construct the play structures 800, 800' having a horse-shaped configuration. In certain embodiments, each of the play structures 800, 800' is constructed from four (4) of the first tubes 12*a*, seven (7) of the fourth tubes 14*a*, twelve (12) of the fifth tubes 14*b*, two (2) of the sixth tubes 14*c*, five (5) of the seventh tubes 14*d*, seven (7) of the 6-way connectors 16*a*, four (4) of the 3-way connectors 16*b*, three (3) of the 90-degree connectors 16*c*, four (4) of the 45-degree connectors 16*d*, and four (4) of the coupling connectors 16*e*.

A frame 802 of the play structures 800, 800', constructed from the tubes 12*a*, 14*a*, 14*b*, 14*c*, 14*d* and the connectors 16*a*, 16*b*, 16*c*, 16*d*, 16*e*, includes a main body 804. As shown in FIG. 16, the main body 804 is formed by releasably assembling the tubes 12*a*, 14*a*, 14*b*, 14*c*, 14*d* together using the connectors 16*a*, 16*b*, 16*c*, 16*d*, 16*e* into a horse-like structure.

As shown in FIG. 17, the play structure 800' further includes the at least one covering 24 releasably affixed to the frame 802. In certain embodiments, the at least one covering 24 is releasably affixed to the frame 802 using the covering connectors 18 (shown in FIG. 1). In particular, an edge of the at least one covering 24 is aligned with one of the tubes 12*a*, 14*a*, 14*b*, 14*c*, 14*d* and secured with one of the covering connectors 18. The covered tubes 12*a*, 14*a*, 14*b*, 14*c*, 14*d* are rolled until the at least one covering 24 is pulled tight and the covering connectors 18 are not visible.

Figure 18:
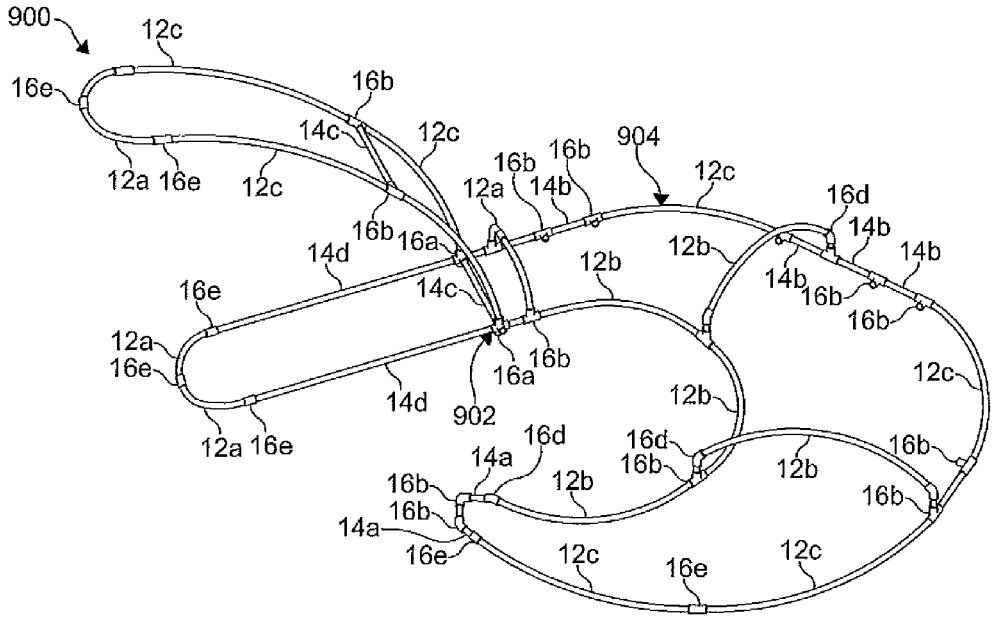
FIG. 18 is a perspective view of a play structure constructed from the kit illustrated in FIG. 1, wherein the play structure has a reptile-shaped configuration.
Figure 19:
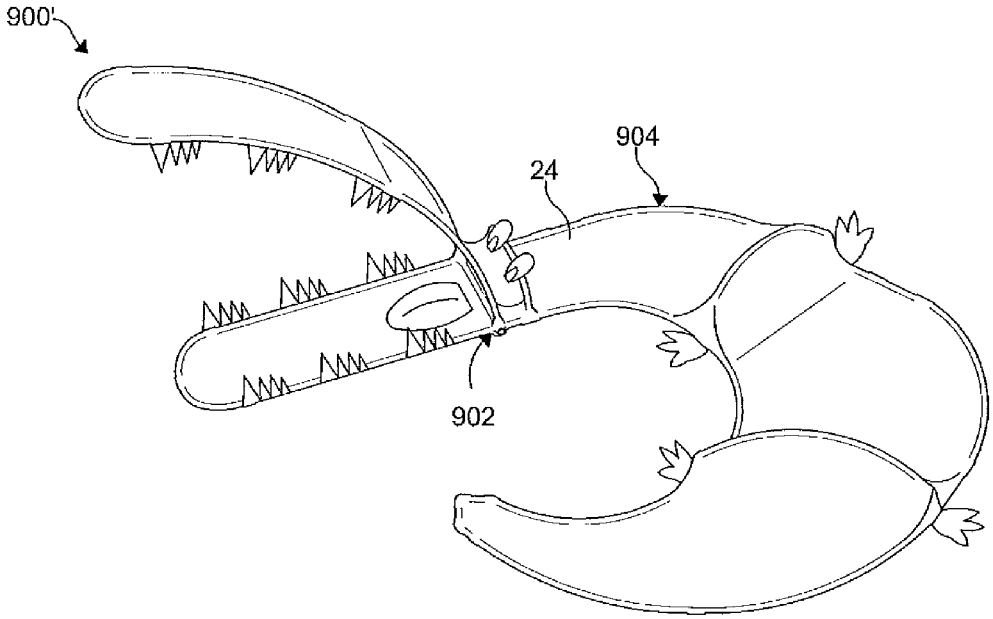
FIG. 19 is a perspective view of the play structure of FIG. 18 having a covering disposed on at least a portion thereof.

As shown in FIGS. 18-19, the kit 10 is used to construct the play structures 900, 900' having a reptile-shaped configuration. In certain embodiments, each of the play structures 900, 900' is constructed from six (6) of the first tubes 12*a*, five (5) of the second tubes 12*b*, eight (8) of the third tubes 12*c*, nine (9) of the fourth tubes 14*a*, six (6) of the fifth tubes 14*b*, two (2) of the sixth tubes 14*c*, two (2) of the seventh tubes 14*d*, two (2) of the 6-way connectors 16*a*, fourteen (14) of the 3-way connectors 16*b*, one (1) of the 90-degree connectors 16*c*, six (6) of the 45-degree connectors 16*d*, and seven (7) of the coupling connectors 16*e*.

A frame 902 of the play structures 900, 900', constructed from the tubes 12*a*, 12*b*, 12*c*, 14*a*, 14*b*, 14*c*, 14*d* and the connectors 16*a*, 16*b*, 16*c*, 16*d*, 16*e*, includes a main body 904. As shown in FIG. 18, the main body 904 is formed by releasably assembling the tubes 12*a*, 12*b*, 12*c*, 14*a*, 14*b*, 14*c*, 14*d* together using the connectors 16*a*, 16*b*, 16*c*, 16*d*, 16*e* into a reptile-like structure.

As shown in FIG. 19, the play structure 900' further includes the at least one covering 24 releasably affixed to the frame 902. In certain embodiments, the at least one covering 24 is releasably affixed to the frame 902 using the covering connectors 18 (shown in FIG. 1). In particular, an edge of the at least one covering 24 is aligned with one of the tubes 12*a*, 12*b*, 12*c*, 14*a*, 14*b*, 14*c*, 14*d* and secured with one of the covering connectors 18. The covered tubes 12*a*, 12*b*, 12*c*, 14*a*, 14*b*, 14*c*, 14*d* are rolled until the at least one covering 24 is pulled tight and the covering connectors 18 are not visible.

Figure 20:
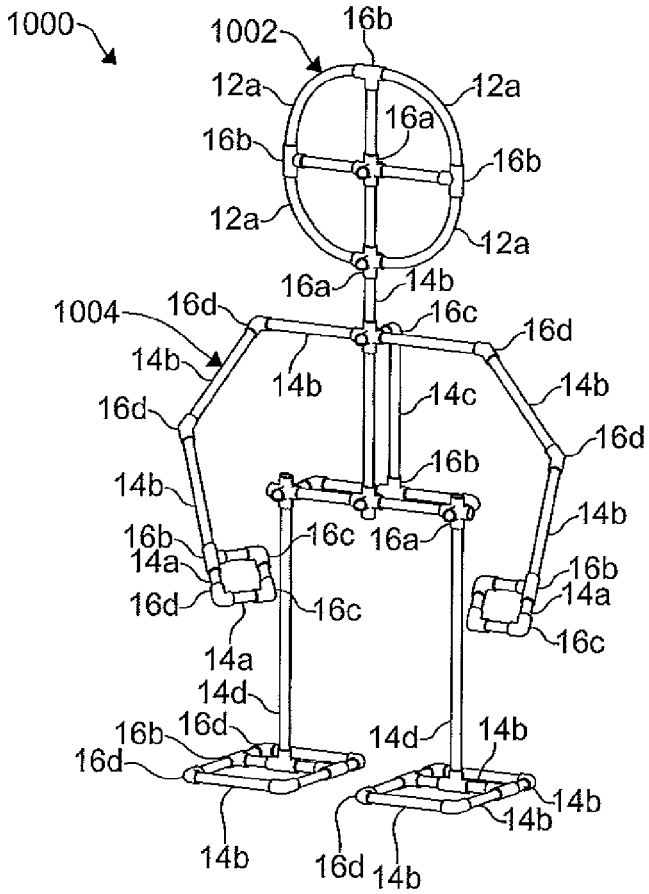
FIG. 20 is a perspective view of a play structure constructed from the kit illustrated in FIG. 1, wherein the play structure has a human-shaped configuration.

As shown in FIG. 20, the kit 10 is used to construct the play structure 1000 having a human-shaped configuration. In certain embodiments, the play structure 1000 is constructed from four (4) of the first tubes 12*a*, nineteen (19) of the fourth tubes 14*a*, twenty-two (22) of the fifth tubes 14*b*, two (2) of the sixth tubes 14*c*, two (2) of the seventh tubes 14*d*, six (6) of the 6-way connectors 16*a*, twelve (12) of the 3-way connectors 16*b*, seventeen (17) of the 90-degree connectors 16*c*, and four (4) of the 45-degree connectors 16*d*.

A frame 1002 of the play structure 1000, constructed from the tubes 12*a*, 14*a*, 14*b*, 14*c*, 14*d* and the connectors 16*a*, 16*b*, 16*c*, 16*d*, includes a main body 1004. As shown, the main body 1004 is formed by releasably assembling the tubes 12*a*, 14*a*, 14*b*, 14*c*, 14*d* together using the connectors 16*a*, 16*b*, 16*c*, 16*d*, into a human-like structure. It is understood that the play structure 1000 may include the at least one covering 24 releasably affixed to the frame 1002 if desired.

Figure 21:
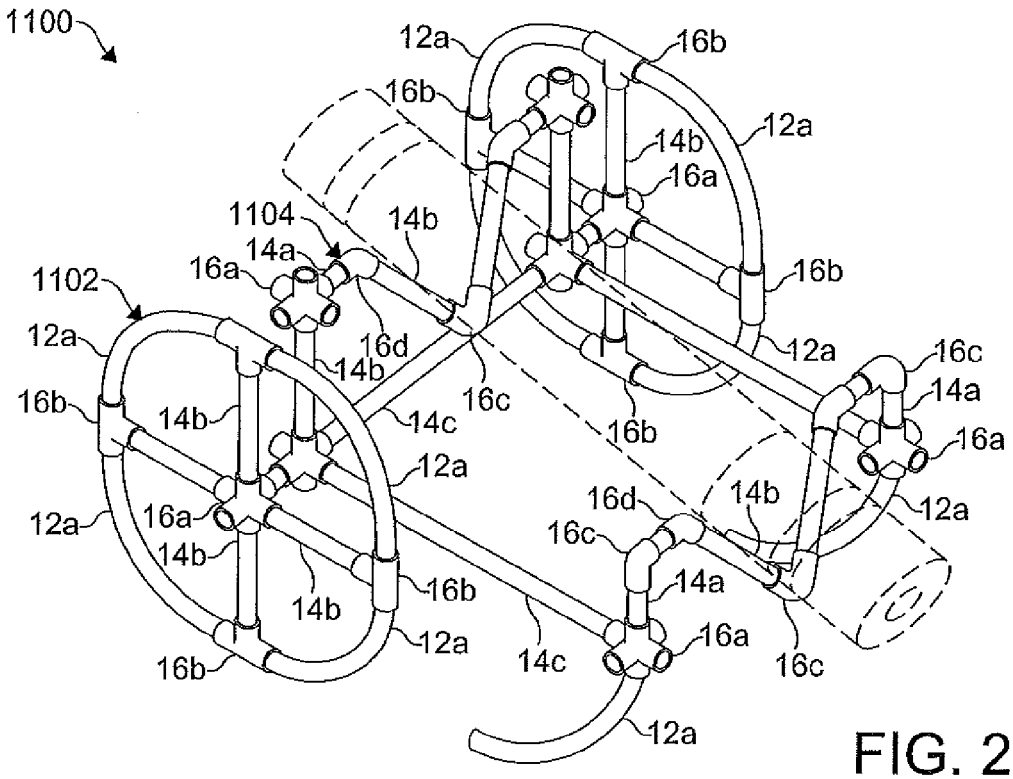
FIG. 21 is a perspective view of a play structure constructed from the kit illustrated in FIG. 1, wherein the play structure has a cannon-shaped configuration.

As shown in FIG. 21, the kit 10 is used to construct the play structures 1100 having a cannon-shaped configuration. In certain embodiments, the play structure 1100 is constructed from ten (10) of the first tubes 12*a*, eight (8) of the fourth tubes 14*a*, fourteen (14) of the fifth tubes 14*b*, three (3) of the sixth tubes 14*c*, eight (8) of the 6-way connectors 16*a*, eight (8) of the 3-way connectors 16*b*, four (4) of the 90-degree connectors 16*c*, and four (4) of the 45-degree connectors 16*d*.

A frame 1102 of the play structure 1100, constructed from the tubes 12*a*, 14*a*, 14*b*, 14*c*, 14*d* and the connectors 16*a*, 16*b*, 16*c*, 16*d*, includes a main body 1004. As shown, the main body 1104 is formed by releasably assembling the tubes 12*a*, 14*a*, 14*b*, 14*c*, 14*d* together using the connectors 16*a*, 16*b*, 16*c*, 16*d*, into a cannon-like structure. It is understood that the play structure 1100 may include the at least one covering 24 or other accessory such as a muzzle-like structure as indicated by dashed lines, for example, releasably affixed to the frame 1102 if desired.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A kit for constructing a variety of play structures for a child, the kit comprising:

a plurality of arcuate first tubes;

a plurality of arcuate second tubes, wherein at least one of the arcuate first tubes and the arcuate second tubes is substantially rigid;

a plurality of linear tubes, wherein the linear tubes are substantially rigid; and a plurality of connectors, the connectors including a 6-way tube connector, a 3-way tube connector, a 90-degree tube connector, a 45-degree tube connector, and a coupling tube connector, the connectors configured for releasably assembling at least one of the arcuate first tubes, the arcuate second tubes, and the linear tubes together with another one of the arcuate first tubes, the arcuate second tubes, and the linear tubes to form a variety of frames for the variety of play structures;

wherein at least one of the frames is configured to fit the child inside the frame.

2. The kit according to claim 1, wherein each of the arcuate first tubes has an arc length in a range of about 8 inches to about 10 inches and an angle of curvature of about 90 degrees.

3. The kit according to claim 1, wherein each of the arcuate second tubes has an arc length in a range of about 17 inches to about 20 inches and an angle of curvature of about 90 degrees.

4. The kit according to claim 1, wherein at least a portion of the linear tubes has a length in a range of about 1 inch to about 4 inches.

5. The kit according to claim 1, wherein at least a portion of the linear tubes has a length in a range of about 3 inches to about 7 inches.

6. The kit according to claim 1, wherein at least a portion of the linear tubes has a length in a range of about 10 inches to about 14 inches.

7. The kit according to claim 1, wherein at least a portion of the linear tubes has a length in a range of about 22 inches to about 26 inches.

8. The kit according to claim 1, further comprising a plurality of arcuate third tubes.

9. The kit according to claim 8, wherein each of the arcuate third tubes has an arc length in a range of about 17 inches to about 20 inches and an angle of curvature of about 45 degrees.

10. The kit according to claim 8, further comprising an instruction manual which provides directions for releasably assembling at least one of the arcuate first tubes, the arcuate second tubes, the arcuate third tubes, and the linear tubes together with the connectors to form the variety of play structures from the kit.

11. The kit according to claim 1, further comprising at least one covering to be releasably affixed to the frame of the play structure.

12. The kit according to claim 11, further comprising at least covering connector to releasably affix the at least one covering to the frame of the play structure.

13. The kit according to claim 1, wherein at least one of the variety of play structures has a transportation vehicle-shaped configuration.

14. The kit according to claim 1, wherein the plurality of linear tubes includes:

a plurality of linear fourth tubes having a length in a range of about 1 inch to about 4 inches;

a plurality of linear fifth tubes having a length in a range of about 3 inches to about 7 inches;

a plurality of linear sixth tubes having a length in a range of about 10 inches to about 14 inches;

a plurality of linear seventh tubes having a length in a range of about 22 inches to about 26 inches, wherein the fourth tubes, the fifth tubes, the sixth tubes, and the seventh tubes are substantially rigid; and the plurality of connectors are configured for releasably assembling at least one of the first tubes, the second tubes, the third tubes, the fourth tubes, the fifth tubes, the sixth tubes, and the seventh tubes together with another one of the first tubes, the second tubes, the third tubes, the fourth tubes, the fifth tubes, the sixth tubes, and the seventh tubes to form a frame.

15. The kit according to claim 1, wherein the plurality of arcuate first tubes, the plurality of arcuate second tubes, and the plurality of linear tubes each have a distinct color to assist in assembling the variety of play structures.

16. The kit according to claim 1, wherein the 6-way tube connector, the 3-way tube connector, the 90-degree tube connector, the 45-degree tube connector, and the coupling tube connector each have a distinct color to assist in assembling the variety of play structures.

17. The kit according to claim 1, wherein at least one of the variety of play structures has an animal-shaped configuration.

18. The kit according to claim 1, wherein at least one of the variety of play structures has a building-shaped configuration.

19. A method of constructing a play structure for a child, the method comprising the steps of:

providing a kit including a plurality of arcuate first tubes, a plurality of arcuate second tubes, wherein at least one of the arcuate first tubes and the arcuate second tubes is substantially rigid, and a plurality of linear tubes, wherein the linear tubes are substantially rigid and a plurality of connectors, the connectors including a 6-way tube connector, a 3-way tube connector, a 90-degree tube connector, a 45-degree tube connector, and a coupling tube connector; and releasably assembling at least one of the arcuate first tubes, the arcuate second tubes, and the linear tubes together with another one of the arcuate first tubes, the arcuate second tubes, and the linear tubes using at least one of the connectors to form a frame of the play structure.

20. The method according to claim 19, wherein the frame is configured to fit the child inside the frame.

* * * * *